United States Patent [19]

Lundgren et al.

[11] 4,174,225

[45] Nov. 13, 1979

[54] MANUFACTURING MOULDS OR MOULD CORES

[75] Inventors: Bert K. G. Lundgren, Nynäshamn; Urban Westin, Saltsjobaden, both of Sweden

[73] Assignees: AB Nynas-Petroleum; AB Westin and Backlund, both of Stockholm, Sweden

[21] Appl. No.: 786,305

[22] Filed: Apr. 11, 1977

[30] Foreign Application Priority Data

Apr. 12, 1976 [SE] Sweden ..... 7604259
Jan. 17, 1977 [SE] Sweden ..... 7700435

[51] Int. Cl.[2] ..... B28B 7/34

[52] U.S. Cl. ..... 106/38.6; 106/38.35; 106/38.8; 164/43

[58] Field of Search ..... 106/38.3, 38.35, 38.8, 106/38.6; 164/43

[56] References Cited

U.S. PATENT DOCUMENTS

| | | | |
|---|---|---|---|
| 2,183,424 | 12/1939 | Clark | 106/38.35 |
| 2,348,155 | 5/1944 | Shanley | 106/38.8 |
| 2,487,207 | 11/1949 | Adams | 106/38.35 |
| 2,491,006 | 12/1949 | Grube | 106/38.8 |
| 2,510,220 | 6/1950 | Grube | 106/38.8 |
| 2,525,175 | 10/1950 | Keyser | 106/38.8 |

*Primary Examiner*—Lorenzo B. Hayes
*Attorney, Agent, or Firm*—Fred Philpitt

[57] ABSTRACT

A method for manufacturing casting molds or mold cores comprising shaping an aqueous mixture of sand, binder, a hydrocarbon resinous material and a porous, heat-resistant inorganic material.

8 Claims, No Drawings

MANUFACTURING MOULDS OR MOULD CORES

The present invention relates to a method of manufacturing moulds or mould-cores from an aqueous mixture of moulding sand, binding agent and carbonaceous material capable of forming lustrous carbon when the mould or mould-core is heated by contact with molten metal, without being previously hardened or dried, the moulding material or mould-core material, subsequent to a casting operation, being re-used to manufacture a further mould or mould-core, whilst adding supplementary quantities of binding agent and carbonaceous material to replace the binding agent and carbonaceous material consumed during a preceding casting operation. More specifically the method relates to the manufacture of green-sand moulds and green-sand cores, which can be used immediately after forming without prior drying and hardening and the sand of which can be reused after the casting has solidified. The term "metal" as used herein relates primarily to iron and to copper and aluminum alloys or other metals whose important properties are not effected by contact of the metals with carbon. By "moulding sand" is herein meant primarily "quartz sand", although the term moulding sand may also include chromite sand, olivine sand and zircon sand. The aforedescribed method of manufacturing moulds or mould-cores is known to the art. In these known methods, it is known in respect of casting iron and other metals to admix the moulding sand with black coal in powder form, hereinafter referred to as black coal flour, this material being capable of forming lustrous carbon when the mould or mould-core is heated by contact with molten metal. Among other things, the black-coal flour prevents sand from adhering to the casting, thereby ensuring that the casting obtains smooth surfaces. Black-coal flour is also effective to reduce the occurrence of faulty castings, as a result of sand-buckle, sand scab etc.

Many theories have been put forward as to the effect of black-coal flour in a green-sand mould. In this regard, the following facts have been established, each of which contributes to the favourable effect of black-coal flour on the properties of the moulding sand:

1. A gas layer is formed between the wall of the mould and the molten metal, which layer prevents the metal wetting the mould wall and reacting with quartz and silicates in the moulding sand.
2. The gas produced by the black-coal flour is a reducing gas which penetrates the hot air in the mould to prevent oxidation of the metal present therein.
3. The black-coal flour faciliates expansion of the quartz.
4. In a temperature range of from 650° to 1200° C., black-coal is precipitated onto the particles of quartz in the sand, forming a skin, by thermal disintegration of hydrocarbons. This black-coal skin isolates the particles of sand from the metal in the mould and prevents any reaction between metal oxide, such as FeO, and quartz.
5. At a temperature of approximately 1000°/1100° C., the black-coal flour is subjected to a dry distillation process, whereby particles of coke are formed. These particles are porous and adsorb water when mixing the sand to the desired mould composition.

The process described under 5 above causes water in the coke particles, bentonite and the fine-grain material to be driven-off when the temperature rises during a casting oepration, and to rise through the wall of the mould towards the mould cavity. This has two important consequences:

a. The binding agent present in the mould composition—normally the clay-mineral bentonite—is prevented from drying out and losing some of its adhesive properties.
b. When the steam reaches the mould cavity, the surfaces of the particles of sand and running metal are cooled.

This formation of steam is the first process to take place when a mould is cast. The remaining reactions mentioned above with regard to black-coal flour or powder occur subsequently thereto as the temperature rises in the wall of the mould. All phases contribute to producing a faultless casting.

One disadvantage associated with the use of black-coal powder as a carbonaceous material capable of forming lustrous carbon resides in the fact that the powder must be dry when mixed with the sand and must have a high degree of fineness. When this very fine material is handled, an extremely dusty atmosphere is created, thereby considerably impairing the working environment in the foundry. Moreover, black-coal contains carcinogenic, polynuclear aromatic hydrocarbons, such as benzo-a-pyrene, and hence should not come into contact with the skin or be inhaled.

Because of the harmful effect of black-coal flour on the environment, attempts have been made to find substitute materials capable of replacing black-coal flour in the present context. Examples of such replacement materials include petroleum pitch, carbon-rich chemical products, such as polystyrene, and asphalt, lignin and carbon-oils. These latter often comprise mixtures of products from the petroleum, coal, wood and oil industries, containing a high percentage of aromatic, naphthenic and aliphatic hydrocarbons and ash, the ash content normally being smaller than 4% by weight, and in particular smaller than approximately 2% by weight.

All of the aforementioned replacement materials have properties which render them relatively unsuitable for mixture with moulding sand to produce favourable mould compositions. As a result of their high gas-content and high lustrous-carbon content, they are admixed with the moulding sand in relatively small quantities compared with the black-coal powder. In addition, when de-gasified, they form relatively small quantities of coke of the same or similar type to that formed with black-coal powder. Thus, when using such replacement materials, the percentage of fine material in the mould material is very small, which is a disadvantage.

When black-coal flour is substituted by a replacement material, the replacement material and the quantities in which it is used are selected so that the properties of the mould material are substantially the same as those of a mould material comprising black-coal flour.

When such replacement materials are used, however, the mould material is progressively depleted of coke particles during its repeated use, these coke particles being consumed. In this way, the mould material becomes devoid of that reserve of water and content of fine particles required to effect a satisfactory casting operation.

Thus, when using such replacement materials, the properties of the mould composition are gradually impaired, with subsequent impairment of the quality of the castings. The percentage of castings which must be rejected thereby increases. In order to overcome this disadvantage encountered when using said replacement materials, the moulding sand has been admixed with supplementary quantities of black-coal flour, to form fresh particles of coke capable of holding the water absorbed. One serious disadvantage encountered when using replacement material is that the replacement material is not capable of forming a sufficient quantity of coke under the prevailing casting conditions, which coke is required to hold the water adsorbed. The present invention is intended to circumvent the disadvantages encountered with black-coal flour is used as an additive in moulding sand whilst retaining the hydrophillic properties of the moulding material.

In investigations leading to the present invention, replacement materials whose use in the present invention will eliminate the disadvantages encountered when using black-coal flour have been systematically examined. Such replacement materials have a carbon content lower than that of known black-coal. Further, they have a relatively high hydrogen content and a relatively low ash content. More specifically, the present invention is based on the use of materials containing hydrocarbons and having the following compositions:

carbon content: 50–90%
hydrogen content: >6.8%
ash content: <4.0%

Owing to its relatively high hydrogen content, the materials in question produce, when heated, a relatively high content of volatile constituents, normally above 45%. The percentage of volatile constituents produced by black-coal will practically always lie beneath this value. Moreover, black-coal contains water in percentages of around 2–15%, which none of the useable replacement materials do. Examples of products falling within the numerical composition given above include the replacement materials aforementioned. An important advantage afforded by certain of the aforementioned materials, from the aspect of environmental care and protection, is that these materials contain no carcinogenic polynuclear aromatic hydrocarbons, or only small quantities of such hydrocarbons.

The invention is characterised in that there is used as a carbonaceous material capable of forming lustrous-carbon when the mould or mould core is heated by contact with molten metal, a hydrocarbon-containing and water-free substance having a carbon content of 50–95%, a hydrogen content of more than 6.8% and an ash content of less than 4.0%, which substance when heated forms small quantities of coke and no carcinogenic polynuclear aromatic hydrocarbons, or only minor quantities of such hydrocarbons, for example benzo-a-pyrene; and in that, in order to compensate the poor ability of the moulding material to retain water, as a result of the small amount of coke formed or the poor ability of the coke formed to bind water, the moulding material has mixed therwith a quantity of fine-grain, porous, hydrophillic, heat-resistant, inorganic material having open pores and a specific surface area of at least 100 $m^2/g$.

The following advantages are obtained when using such a replacement material:

1. The material can be used in pellet form, whereby no dust is formed.
2. When no black-coal flour is used, the moulding material will contain no carcinogenic polynuclear aromatic hydrocarbons, or only minor quantities of such hydrocarbons.
3. The moulding material will contain a high percentage of lustrous carbon. This content is five to six times that obtained when using black-coal flour.
4. The moulding material will have a high gas-content. This gas content can be 2.5 to 3 times that obtained when using black-coal flour.
5. The moulding material will have a low ash-content.
6. Pelletised material can be mixed more readily with moulding sand.

Thus, in the present invention, instead of water-adsorbent coke formed by black-coal flour when heated during a casting operation, there is used a fine, porous hydrophillic heat-resistant inorganic material having a particle-size distribution suitable for the moulding sand used with regard to obtaining a moulding material have a suitable mean-particle size and a suitable quantity of fine-grain material. The desired water-adsorbing properties can be obtained with a material having a specific surface area of at least 100 $m^2/g$. The value of the specific surface area is a measure of the adsorption property of the material.

The content of fine, porous, hydrophillic heat-resistant material can be obtained by adding a material obtained by expanding an aqueous material. For example, the desired content can be obtained by adding expanded perlite.

Expanded perlite is a suitable material for achieving the object of the invention. One raw material from which expanded perlite can be obtained is a volcanic rock containing approximately 2–5% water, which when viewed chemically comprises aluminum silicate. When heated to 1260° C., the aluminium silicate gives off its water of crystallisation and expands greatly. The expanded perlite is porous and adsorbs more than its own weight of liquid. It is heat-resistant to a temperature of approximately 1300° C., it has a low density and is completely safe from the environmental aspect. The silica present is completely bound in silicate form.

Expanded perlite has the following chemical composition:

$SiO_2$: 76–78%
$Al_2O_3$: 11–13.5%
$Fe_2O_3$: approximately 0.7%
CaO: 0.5–1.3%
MgO: approximately 0.5%
$K_2O$,$Na_2O$: 7–10%

Other materials suitable as additives in the above respect are expanded vermiculite, or cinders, or calcined diatomaceous earth, or pumice-stone.

Bentonite is a suitable binding agent in the method according to the invention.

The invention also relates to a moulding material for use in the method according to the invention. The moulding material comprises an aqueous mixture of moulding sand, binding agent and carbonaceous material capable of forming lustrous carbon when the mould or mould core is heated by contact with molten metal. In accordance with the invention, said carbonaceous material capable of forming lustrous carbon when the mould or mould core is heated by contact with molten metal, contains a water-free substance which contains hydrocarbons and has a carbon-content of 50–95%, a hydrogen-content of more than 6.8% and an ash-content of less than 4.0%, which substance when heated forms minor quantities of coke and no carcinogenic polynuclear aromatic hydrocarbons, such as benzo-a-pyrene, or only minor quantities of such hydrocarbons, and a fine, porous, hydrophillic heat-resistant inorganic material having open pores and a specific surface area of at least 100 $m^2/g$, in order to compensate the poor ability of the moulding material to retain water as a result of the small amount of coke formed or the poor ability of the coke formed to bind water.

Carbonaceous materials capable of forming lustrous carbon in accordance with the above include resin products obtained by oxidative polymerisation of mineral oil distillates and/or solvent extracts having a content of aromatically-bound carbon corresponding to a VGC-value of at lowest 0.85 and having a mean molecular weight of 150–600, which resin products have an initial boiling point of at least 300° C. at 760 mm Hg.

The majority of hydrocarbon-containing material having a carbon content of 50–95% and a relatively high hydrogen content, of at least 6.8%, normally have a relatively low ash content, lying at most at 2%. Materials having such low ash content are advantageous in the present context, since they do not alter the particle distribution of the foundry sand to the same extent as materials having a higher ash content, e.g. an ash content in excess of 4%. Thus, when used in the present invention, materials having a relatively high percentage of ash do not require the application of excessively comprehensive measures to maintain the correct particle size distribution in the foundry sand material. Methods of preparing the aforementioned petroleum resins are described more specifically in Swedish Pat. Nos. 383,528 and 388,870, those passages in the specifications relevant to the present invention forming part of this description.

Extracts suitable for oxidative polymerisation processes are obtained by using the so-called double-solvent process, in which there are used mutually immiscible solvents, such as cresol and propane. Particularly preferred are Edeleanu extracts and furfural extracts of petroleum distillate, i.e. extracts obtained by using liquid sulphur-dioxide in combination with benzene, or extracts obtained with furfural. The extracts are materials of high boiling point, which materials may in general be liquids or highly-viscous materials. Extracts having a boiling point above 300° C. at 760 mm Hg and containing more than 30% aromatically-bound carbon are best suited for the oxidation process.

In accordance with one important embodiment of the present invention, the petroleum resin in question may be used in spray-chilled form, thereby considerably reducing the tendency of the resin to form dust, the presence of such dust in the foundries being highly undesirable from the sanitary aspect.

In accordance with a further embodiment of the invention, the resin product used may be a product having a high initial boiling point, i.e. an initial boiling point of at least 400° C.

The present invention also relates to a moulding material comprising a mixture of moulding sand, binding agent and a material capable of forming lustrous carbon, characterised in that the material capable of forming lustrous carbon contains the aforedefined petroleum resin.

We claim:

1. In a method of manufacturing casting moulds or mould cores comprising shaping an aqueous mixture of (a) a moulding sand, (b) a binding agent, and a carbonaceous material consisting of (c) a black coal flour capable of forming lustrous carbon when the mould or mould core is heated by contact with molten metal, without previous hardening or drying, the mould material or mould core material being recycled to manufacture fresh moulds or mould cores by adding supplementary binding agent and carbonaceous material to replace binding agent and carbonaceous material consumed during a preceding casting operation; the improvement which comprises adding, in place of the black coal flour, a combination of:

(1) a water-free, hydrocarbon-containing substance having a carbon content of 50–95%, a hydrogen-content of more than 6.8% and an ash-content of less than 4.0%, which substance when heated forms minor quantities of coke and no carcinogenic polynuclear aromatic hydrocarbons such as benzo-a-pyrene said hydrocarbon containing substance comprising a resin product obtained by oxidative polymerization, either with or without catalysts, of a mineral oil distillate or solvent extract having a content of aromatically-bound carbon corresponding to a VGC-value of at least 0.85 and a mean molecular weight of 150–600, which resin product has an initial boiling point of at least 300° C. at 750 mm Hg, and (2) a fine, porous, hydrophilic, heat-resistant inorganic material having open pores and a specific surface area of at least 100 $m^2/g$, the amount of said inorganic material being sufficient to compensate for the poor ability of the moulding material to retain water as a result of the small amount of coke formed or the poor ability of the coke formed to bind water.

2. A method according to claim 1 wherein said inorganic material is obtained by expanding hydrated minerals.

3. A method according to claim 2 wherein said inorganic material is expanded perlite.

4. A method according to claim 2 wherein said inorganic material is expanded vermiculite, or calcined diatomaceous earth.

5. A method according to claim 1 wherein said inorganic material is pumice-stone.

6. A method according to claim 1 wherein said binding agent is bentonite.

7. A method according to claim 1 wherein said resin product is added in spray-cooled form.

8. A method according to claim 1 wherein said resin product has an initial boiling point of at least 400° C. at 760 mm Hg.

* * * * *